United States Patent [19]

Etoh

[11] 4,085,720

[45] Apr. 25, 1978

[54] FUEL SUPPLY SYSTEM FOR MULTI-FUEL INTERNAL COMBUSTION ENGINES

[75] Inventor: Motoaki Etoh, Ageo, Japan

[73] Assignee: Fuji Jukogyo Kabushiki Kaisha, Tokyo, Japan

[21] Appl. No.: 713,513

[22] Filed: Aug. 11, 1976

[51] Int. Cl.[2] ..... F02M 13/00; F02M 13/04; F02M 13/08

[52] U.S. Cl. ..... 123/127; 123/179 G; 123/119 F

[58] Field of Search ..... 123/127, 121, 179 G, 123/119 F, 3; 261/18

[56] References Cited

U.S. PATENT DOCUMENTS

| | | | |
|---|---|---|---|
| 1,983,957 | 12/1934 | White | 261/18 R |
| 2,337,982 | 12/1943 | Ericson | 261/18 R |

*Primary Examiner*—Wendell E. Burns
*Attorney, Agent, or Firm*—Martin A. Farber

[57] ABSTRACT

Fuel supply system for multi-fuel internal combustion engines having a selector valve for controlling the feed of fuels such as gasoline and kerosene and a vacuum actuator to operate the selector valve according to the pressure in intake passage of the engine. A valve for communicating the vacuum chamber of the vacuum actuator to the atmosphere is provided so as to be operated in the cold, so that vacuum actuator acts on the selector valve for feeding the gasoline, if the choke valve is closed.

3 Claims, 3 Drawing Figures

FUEL SUPPLY SYSTEM FOR MULTI-FUEL INTERNAL COMBUSTION ENGINES

The present invention relates to a fuel supply system for multi-fuel internal combustion engines such as gasoline-kerosene engines driven by gasoline and or kerosene, and more particularly to a system for supplying gasoline and kerosene from each fuel chamber to the intake passage of carburetor.

There is provided a system for controlling the feeding of gasoline and kerosene according to pressure in the intake passage of the engine. In the system, a selector valve operated by the pressure in the intake passage is provided so that gasoline is fed to the carburetor at atmospheric pressure or low negative pressure in the intake passage and kerosene is fed at high negative pressure in the intake passage. During starting of the engine, the pressure in the intake passage is atmospheric pressure and a low negative pressure arises in the intake passage when the throttle valve is opened at a small opening ratio or is fully opened. Accordingly, gasoline is supplied at the start and at a low speed or high speed. On the contrary, a high negative pressure arises when the throttle valve is opened at a middle opening ratio, where kerosene is fed to the carburetor. However, such relation between the pressure in the intake passage and the throttle valve opening ratio may be presented when the choke valve is fully opened. When the choke valve is closed for starting the engine in the cold, the negative pressure in the intake passage is increased, even if the throttle valve is opened. Increase of the negative pressure in the intake passage causes the fuel supply system to feed the kerosene. It will be noted that it is desirable to drive the engine by gasoline at the start, but the gasoline feeding is changed to kerosene feeding if the choke valve is closed. Therefore, engine performance during the warming-up is reduced, because vaporability of kerosene is lower than that of gasoline.

Accordingly, an object of the present invention is to provide a fuel supply system which may feed gasoline during the warming-up even if the choke valve is closed. In accordance with the present invention, the system is so composed that the selector valve is not influenced by negative pressure in the intake passage during the warming-up of the engine in the cold whereby the selector valve is positioned to open the port to feed gasoline.

The accompanying drawings illustrate embodiments of the present invention:

Figure 1:
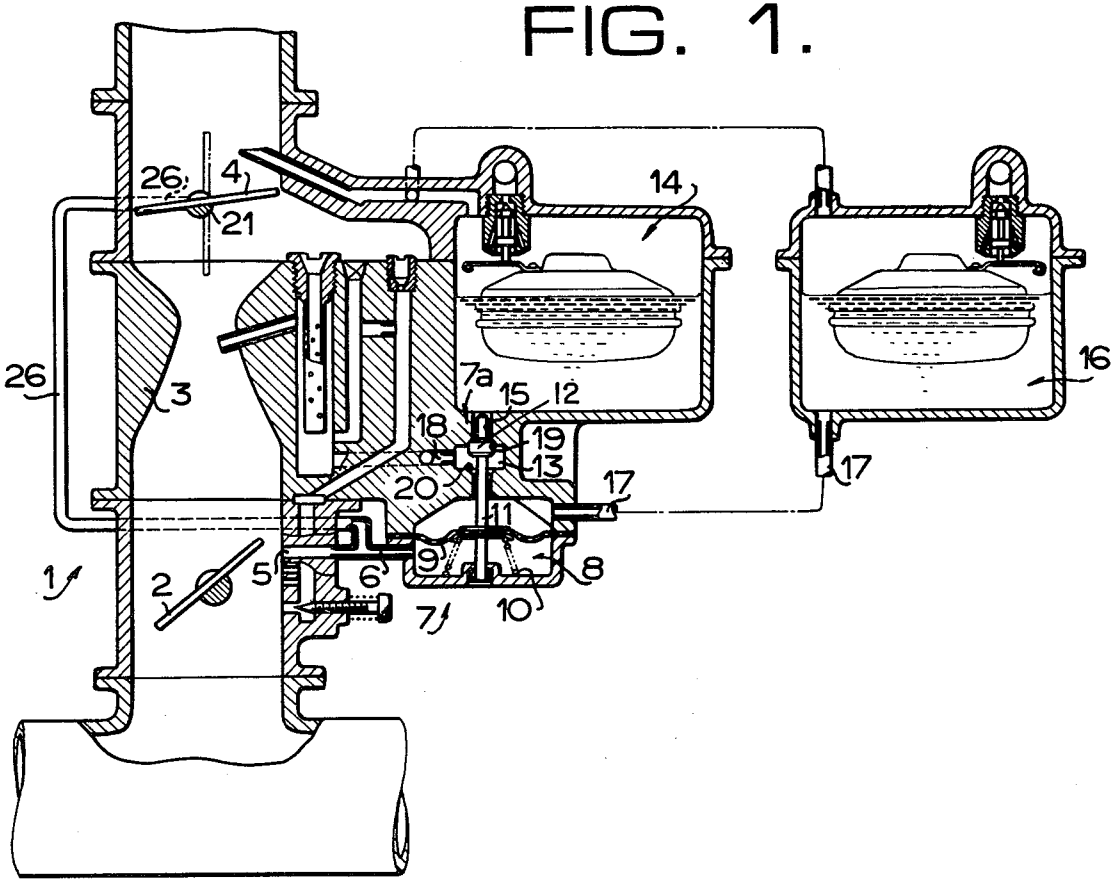
FIG. 1 is a sectional view of a fuel supply system embodying the present invention.

Referring to FIG. 1, numeral 1 is an intake passage of a carburetor in which a throttle valve 2, a venturi 3 and a choke valve 4 are provided. A pressure inlet 5 is positioned near above the throttle valve 2. The pressure inlet 5 is communicated to a vacuum chamber 8 of a vacuum actuator 7 via a passage 6. The vacuum chamber 8 is partitioned by a diaphragm 9 which is connected to a rod 11 of a piston 12 of a selector valve 7*a*. A valve chamber 13 is communicated to a kerosene float chamber 14 through a passage 15 and to a gasoline float chamber 16 through a passage 17. The valve chamber 13 is also communicated to a carburetor via a passage 18. The piston 12 is adapted to be positioned to close a port 19 or a port 20.

Figure 2:
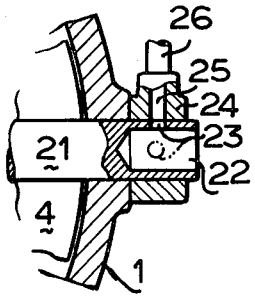
FIG. 2 is a sectional view of a part of the shaft of the choke valve.

Referring to FIG. 2, a valve means is provided at the outer end portion of the shaft 21 of the choke valve 4. The valve means comprises an axial bore 22 at a projected end portion and a port 23. A bearing member 24 secured to the wall of the intake passage 1 has a valve port 25 which coincides with the port 23 when the choke valve is closed. The valve port 25 is communicated to the passage 6 by a branch passage 26.

In the case that the choke valve 4 is opened, and thereby the valve port 25 is closed, at the start of the engine, the pressure in the intake passage is atmospheric pressure. Accordingly, the diaphragm 9 is biased by the spring 10 so that the piston 12 closes the port 19, thereby gasoline is fed to the carburetor from the gasoline float chamber 16 passing through the passage 17, port 20, chamber 13 and passage 18. When the throttle valve is opened at a middle opening ratio, high negative pressure arises in the intake passage. The high negative pressure biases the diaphragm 9 against the spring 10 to move the piston 12 to close the port 20 and to open the port 19, so that kerosene is fed from the kerosene float chamber 14 to the carburetor passing through the port 19 and passage 18.

At a cold season, if the choke valve 4 is closed, the port 23 of the valve means coincides with the port 25. Accordingly, passage 6 is communicated to atmosphere via the branch passage 26, ports 25 and 23 and axial bore 22. Consequently, the vacuum chamber 8 is communicated to the atmosphere and thereby is not subjected to the negative pressure arising in the intake passage. Therefore, gasoline is fed to the carburetor passing through the port 20 and passage 18. When the choke valve 4 is opened after completion of warming-up, the valve port 25 is closed and the vacuum chamber 8 is communicated to the pressure inlet 5. Thus, the selector valve 7 is operated according to the pressure in the above described manner. The angular range within which the valve port 25 is opened is determined according to necessary gasoline feeding range in the rotational range of the choke valve.

Figure 3:
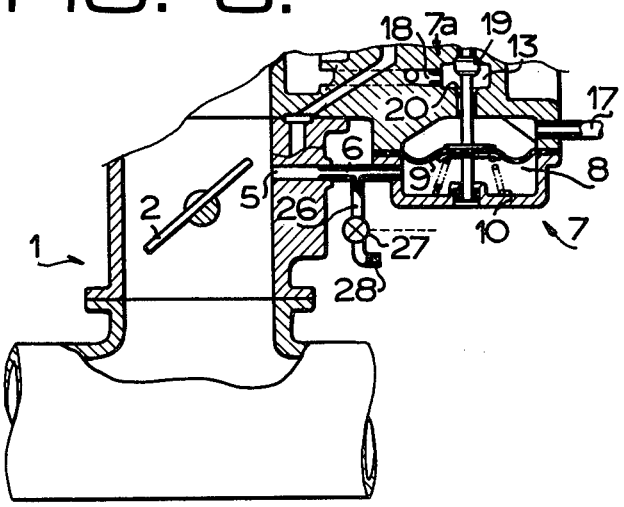
FIG. 3 is a partial sectional view of another embodiment of the present invention.

In the embodiment shown in FIG. 3, a solenoid operated valve 27 is provided in a branch passage 28 connected to the passage 6. The end of the branch passage 28 is opened to the atmosphere. The solenoid operated valve 27 is provided to be operated by a thermally operated switch at a predetermined temperature of the cooling water of the engine.

When the temperature of the engine is low during the warming-up, the solenoid valve 27 is operated to open the passage 28 so that the passage 6 is communicated to the atmosphere. Accordingly, the negative pressure in the intake passage does not act on the vacuum chamber 8, and thereby gasoline is fed to the carburetor. When the temperature of the cooling water rises to a predetermined temperature after warming-up, the solenoid valve 27 is operated to close the passage 28.

From the foregoing, it will be understood that the present invention provides a fuel supply system which may supply gasoline during the warming-up in the cold.

What is claimed is:

1. A fuel supply system for multi-fuel internal combustion engines, comprising a carburetor having an intake passage, and a throttle valve operatively disposed in said intake passage, a first fuel chamber for first fuel, a second fuel chamber for second fuel, fuel feeding passages means for respectively feeding the fuels from said first and second fuel chambers, respectively, to said carburetor, said fuel feeding passages means defining closable ports, respectively, communicating with said first and second fuel chambers, respectively, a selector valve means for selectively opening and closing said ports of said fuel feeding passages means, a vacuum actuator means for operating said selector valve means, a first passage communicating said vacuum actuator means with the intake passage at a position adjacent, above and upstream of a closed position of said throttle valve, said selector valve means upon communication with atmosphere pressure for opening one of said ports communicating with said first fuel chamber for the first fuel and upon communication with a negative pressure for opening the other of said ports communicating with said second fuel chamber for the second fuel, a branch passage connected to said first passage, another valve means provided in said branch passage for communicating said branch passage to atmosphere, and means for operating said another valve means to open itself and said branch passage to atmosphere in the cold.

2. The fuel supply system for multi-fuel internal combustion engines in accordance with claim 1, further comprising a shaft pivotally disposed in said intake passage, a choke valve mounted on said shaft, said means for operating said another valve means is provided on said shaft of said choke valve for opening of said another valve means to atmosphere at a closed position of said choke valve.

3. The fuel supply system for multi-fuel internal combustion engines in accordance with claim 1, in which said means for operating the said another valve means is a thermally operated valve means for opening to atmosphere in the cold.

* * * * *